US009468285B2

(12) United States Patent
Martinez

(10) Patent No.: US 9,468,285 B2
(45) Date of Patent: Oct. 18, 2016

(54) MULTIPURPOSE STRAP DEVICE FOR SECURING, FASTENING, REMOVABLY ATTACHING, CARRYING, STORING, HOLDING AND/OR LOCKING ITEMS AND/OR OBJECTS

(71) Applicant: Roger Martinez, Yonkers, NY (US)

(72) Inventor: Roger Martinez, Yonkers, NY (US)

( * ) Notice: Subject to any disclaimer, the term of this patent is extended or adjusted under 35 U.S.C. 154(b) by 0 days.

(21) Appl. No.: 14/682,487

(22) Filed: Apr. 9, 2015

(65) Prior Publication Data

US 2015/0351524 A1 Dec. 10, 2015

Related U.S. Application Data

(60) Provisional application No. 62/008,339, filed on Jun. 5, 2014.

(51) Int. Cl.

| | |
|---|---|
| ***A45F 5/02*** | (2006.01) |
| ***A44B 15/00*** | (2006.01) |
| ***D05B 15/00*** | (2006.01) |
| ***A45C 13/30*** | (2006.01) |

(Continued)

(52) U.S. Cl.

CPC ..... *A45F 5/02* (2013.01); *A44B 15/00* (2013.01); *A45C 13/30* (2013.01); *D05B 15/00* (2013.01); *A45C 13/20* (2013.01); *A45C 2001/062* (2013.01); *A45F 5/00* (2013.01); *A45F 2005/006* (2013.01); *F41C 27/00* (2013.01); *Y10T 24/1388* (2015.01); *Y10T 24/1397* (2015.01); *Y10T 24/25* (2015.01); *Y10T 24/27* (2015.01); *Y10T 24/2775* (2015.01); *Y10T 24/32* (2015.01); *Y10T 24/33* (2015.01); *Y10T 24/3497* (2015.01); *Y10T 24/44017* (2015.01); *Y10T 24/44026* (2015.01); *Y10T 24/44222* (2015.01); *Y10T 24/44231* (2015.01)

(58) Field of Classification Search

CPC ..... A41F 15/02; A41F 19/005; A42B 3/08; A44B 18/00; A45C 13/00; A45C 13/001; A45F 2003/001; A45F 3/02; A45F 3/12; A63C 11/025; B32B 2307/744; B32B 2559/00; B32B 3/28; B32B 5/04; F16L 3/233; G03B 17/568; G03B 2215/0596; Y10T 24/2708; Y10T 24/27; Y10T 428/14; Y10T 24/14; Y10T 24/2733; Y10T 24/275; Y10T 24/2758; Y10T 24/2775; Y10T 24/2792; Y10T 24/3485; Y10T 29/49826; Y10T 428/1438; Y10T 428/1443; Y10T 428/1457; Y10T 428/1471; Y10T 428/1476; Y10T 428/24; Y10T 428/24008; Y10T 428/24017; Y10T 428/24025; Y10T 428/24777; Y10T 428/24793; Y10S 2/92

USPC ..... 24/16 R, 306, 370, 442, 445, 447, 448, 24/450, 452

See application file for complete search history.

(56) References Cited

U.S. PATENT DOCUMENTS 3,994,048 A * 11/1976 Rosenthal ..... A63C 11/025 24/16 R
4,858,249 A * 8/1989 Stewart ..... A41F 15/02 2/305

(Continued)

*Primary Examiner* — Robert J Sandy
*Assistant Examiner* — David Upchurch
(74) *Attorney, Agent, or Firm* — Richard Mark Blank, Esq.

(57) ABSTRACT

The present invention is a multipurpose strap device for securing, fastening, removably attaching, carrying, storing holding, and/or locking items and/or objects. One current embodiment allows for carrying a helmet on a motorcycle by securing said helmet to said motorcycle via the multipurpose strap device. Other embodiments find use of the invention as a wallet, carrying case, or other storage device.

7 Claims, 4 Drawing Sheets

(51) Int. Cl.

| | |
|---|---|
| *A45C 13/20* | (2006.01) |
| *A45F 5/00* | (2006.01) |
| *A45C 1/06* | (2006.01) |
| *F41C 27/00* | (2006.01) |

(56) References Cited

U.S. PATENT DOCUMENTS 5,737,777 A * 4/1998 Hilleary ..... A42B 3/08 2/421
5,827,589 A * 10/1998 Autterson ..... A44B 18/00 24/306
6,081,925 A * 7/2000 Reiber ..... A41F 19/005 2/125
2012/0070610 A1* 3/2012 Couch, III ..... G03B 17/568 428/100
2013/0230679 A1* 9/2013 Czerniel ..... A45C 13/00 428/41.4

* cited by examiner

MULTIPURPOSE STRAP DEVICE FOR SECURING, FASTENING, REMOVABLY ATTACHING, CARRYING, STORING, HOLDING AND/OR LOCKING ITEMS AND/OR OBJECTS

CROSS-REFERENCE TO RELATED APPLICATIONS

This application claims the benefit of U.S. Provisional Application No. 62/008,339, filed Jun. 5, 2014.

BACKGROUND OF THE INVENTION

The invention is in the field of straps, fasteners, and securing devices, more particularly, in the field of methods to hold and secure helmets to motorcycles.

SUMMARY OF THE INVENTION

The present invention is a multipurpose strap device for securing, fastening, removably attaching, carrying, storing, holding, and/or locking items and/or objects. In one embodiment, the multipurpose strap device for securing, fastening, removably attaching, carrying, storing, holding, and/or locking items and/or objects may comprise at least one of: a first end, a second end, at least one first substrate, at least one second substrate, at least one third substrate, at least one structural piece or bull nose, at least one permanent means of attachment between said at least one first substrate and/or said at least one second substrate and/or at least one third substrate, and/or at least one means of removable attachment between said at least one first substrate and said at least one first substrate and/or said at least one second substrate and/or said at least one third substrate. One embodiment of the present invention can further comprise at least one structural piece or bull nose that can be permanently attachable to and/or contained within said at least one first substrate and/or said at least one second substrate and/or said at least one third substrate. One embodiment of the present invention can further comprise at least one indent and/or cross-section changing section along the length axis of said multipurpose strap device to permit at least one zone of flexure. One embodiment of the present invention can further comprise at least one flexible reinforcing material forming at least one loop at at least one end, wherein said at least one loop has an opening at a first side and an opening at a second side through which an external object can pass through. One embodiment of the present invention can further comprise an additional strap with a first end permanently attached to the device, and a second end having a removably attachable device to removably attach said second end of said additional strap to the at least one first substrate, at least one second substrate, and/or at least one third substrate.

In one embodiment of the present invention, said invention can be at least one of a wallet when fully folded, a wallet wearable strap-on pouch, a key holder, a card holder, a cell phone holder, a money holder, a money clip holder, a holster, a strap for carrying personal items, a strap for holding motorcycle, bicycle, and/or other protective helmet and/or headwear, and/or a strap that can be attached to and/or used with at least one of cameras, mobile phones, computers, smart devices, guns, backpack, carrying cases, briefcases, gym bags, bowling ball bags, laundry bags, grocery bags, baskets, tools, tool boxes, and/or tool belts.

Said at least one first substrate and/or said at least one second substrate and/or said at least one third substrate can be composed of at least one of natural and/or synthetic material including but not limited to at least one of leather and/or animal hide, cotton, wool, fabric, nylon, rayon, plastic, metal, ceramic, composite material, recycled material, Velcro, or any combination thereof. Said permanent means of attachment can be at least one of sewing, riveting, stapling, screwing, eyelets, swaged metal, cementing, gluing, adhesion, thermoforming, melting, at least one hook and eyelet and/or loop, at least one button, at least one snap, at least one magnet, at least one zipper, and/or at least one locking mechanism. Said at least one first substrate and said at least one second substrate and/or said at least one third substrate can be joined together to form at least one internal cavity and/or at least one pouch and/or form the ability to contain and/or enclose at least one volume space. Said at least one first substrate and/or said at least one second substrate and/or said at least one third substrate can have attached at least one first gender of Velcro, said at least one first substrate and/or said at least one second substrate and/or said at least one third substrate can have attached at least one second gender of Velcro and/or at least one first substrate and/or said at least one second substrate, and/or said at least one third substrate can be at least one first gender of Velcro and/or at least one second gender of Velcro. Said removable attachment can be at least one removable method of attachment comprising at least one of Velcro, at least one hook and eyelet and/or loop, at least one button, at least one snap, at least one magnet, at least one zipper, and/or at least one locking mechanism. Said at least one structural piece or bull nose can be composed from at least one of natural and/or synthetic material, leather and/or animal hide, cotton, wool, fabric, nylon, rayon, plastic, metal, ceramic, wood, and/or any combination thereof. Said at least one structural piece or bull nose can be contained within and between at least one of a space formed between at least one first substrate and at least one second substrate, a space formed between at least one second substrate and at least one third substrate, and/or a space formed between at least one first substrate and at least one third substrate. Said first end and/or said second end can pass through at least one helmet face shield hole and/or helmet opening contained in at least one helmet. Said flexible reinforcing material can be comprised of at least one of metal, metal wire, braided wire, steel rope, plastic, composite material, clamp, thimble, eye, clevis, stud, fitting, ball with shank, sleeve, and/or loop. Said strap can have a width of 4 inches and a length of between 14 inches and 20 inches, and can have a length to width ratio of between 3:1 and 12:1.

In one embodiment, the attachment of the at least one first substrate, at least one second substrate, and/or at least one third substrate to the at least one first substrate, at least one second substrate, and/or at least one third substrate can form a pocket.

A possible method of using a multipurpose strap device for securing, fastening, removably attaching, carrying, storing, holding and/or locking items and/or objects for securing and holding in place a motorcycle helmet to a motorcycle seat comprising can follow at least one of the following steps: Unfurl strap prior to attachment to motorcycle seat; Place loose objects into at least one internal cavity and/or at least one pouch; Temporarily seal and/or cause to be closed said at least one internal cavity and/or at least one pouch; Said strap first end is threaded under the rear motorcycle seat strap or at least one of a belt, sissy bar, motorcycle handle bar, bicycle handle bar, any tube or sub-assembly with 360 degree access, on a body part and/or extremity, an arm, a leg, a neck; Thread said strap through a motorcycle helmet in such a manner that said strap enters or exits the helmet opening and exits or enters the helmet face shield hole; Attach said strap first end to strap second end via any claimed said removable method of attachment; and/or Roll up and lock to itself and transport and/or secure by at least one of but not limited to hand carry, place within a pocket, place within another enclosure.

A possible method of manufacturing the current embodiment of the invention comprising at least one of the following: Starting with at least one of soft leather substrate approximately 4"×14" possessing a first side and a second side and a first end and a second end, a thin structural piece of plastic and/or metal and/or hard material approximately 3.8"×2.5" (located at first end), Velcro first gender substrate 4"×14" (loop), Velcro second gender strap closure element approximately 4"×4½" (hook) (located at second end), A pocket and open enclosure forming piece of leather 3.5×3.25 (length) with a top side and a bottom side, Velcro second gender pocket closure element (hook) approximately ¼"×¾" with an active surface and a non-active surface; Sew the non-active surface of the Velcro second gender pocket closure element (hook) to bottom side of the pocket and open enclosure forming piece of leather along the edge that is 3.25 inch long, aligning the ¾" dimension with the 3.25" long edge, starting at a distance of approximately 7/16" from the edge of the 3.5" long edge, thus forming the leather pocket subassembly; Attach the Velcro second gender strap closure element 4"×4½" (hook) to the Velcro first gender substrate 4"×14" (loop) by overlapping the two by approximately ½" such that the mated dimensions form a Velcro subassembly that is approximately 4" wide by 18" long. Sew this union with a line of Velcro attachment stitches that is 4" long along the edge of the Velcro second gender strap closure element 4"×4½" (hook). The Velcro first gender substrate (loop) is the top of the Velcro subassembly and the Velcro second gender strap closure element (hook) side is the bottom of the Velcro subassembly. The 4" end farthest away from the sewn union of Velcro attachment stitches is the first end of the Velcro subassembly and the sewn end of Velcro attachment stitches is the second end of the Velcro subassembly; Create a pocket and open enclosure as follows: within ½" of the Velcro attachment stitches at the second end, orient the leather pocket subassembly on the Velcro first gender substrate with active surface facing up such that the 3.25" dimension of the leather pocket subassembly is aligned with the length of the strap and the 3.5" dimension is aligned with and centered within the 4" width of the strap and parallel to the Velcro attachment stitches. The top side of leather pocket subassembly faces up and the bottom side of the pocket and open enclosure forming piece of leather faces the Velcro first gender substrate (loop), and thus the active surface of the Velcro second gender pocket closure element (hook) on the leather pocket subassembly mates with and attaches to the active surface of the Velcro first gender substrate. This will form the Velcro and pocket subassembly after the following operations, which are not order specific: Sew the top (closest to the second end) across the 3.5 inch width to form the top and first side of the pocket, Sew the bottom (farthest from the second end) across the 3.5 inch width to form the bottom and first side of the open enclosure, Sew the middle (approximately 1⅝" from the top and approximately 1⅝" from the bottom across the 3.5 inch width to form both the bottom and second side of the pocket and the top and second side of the open enclosure, and Sew the left and third side forming the pocket along the 1⅝" length (parallel to the length of the strap); Inset structural piece between soft leather substrate second side at the first end and the Velcro and pocket subassembly bottom and first end. Structural piece is oriented such that the 3.8" dimension is centered within the 4" width of both soft leather substrate and Velcro and pocket subassembly; Soft leather substrate and Velcro and pocket subassembly are stitched together along the perimeter to form a stitched rectangle that is approximately 4 inches wide and approximately 14 inches long; and/or Another line is stitched along the 4" width to capture and contain the structural piece sandwiched between the soft leather substrate and Velcro and pocket subassembly.

Although preferred embodiments of the present invention have been described it will be understood by those skilled in the art that the present invention should not be limited to the described preferred embodiments. Rather, various changes and modifications can be made within the spirit and scope of the present invention.

BRIEF DESCRIPTION OF THE SEVERAL VIEWS OF THE DRAWING

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE INVENTION

Detailed descriptions of particular embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
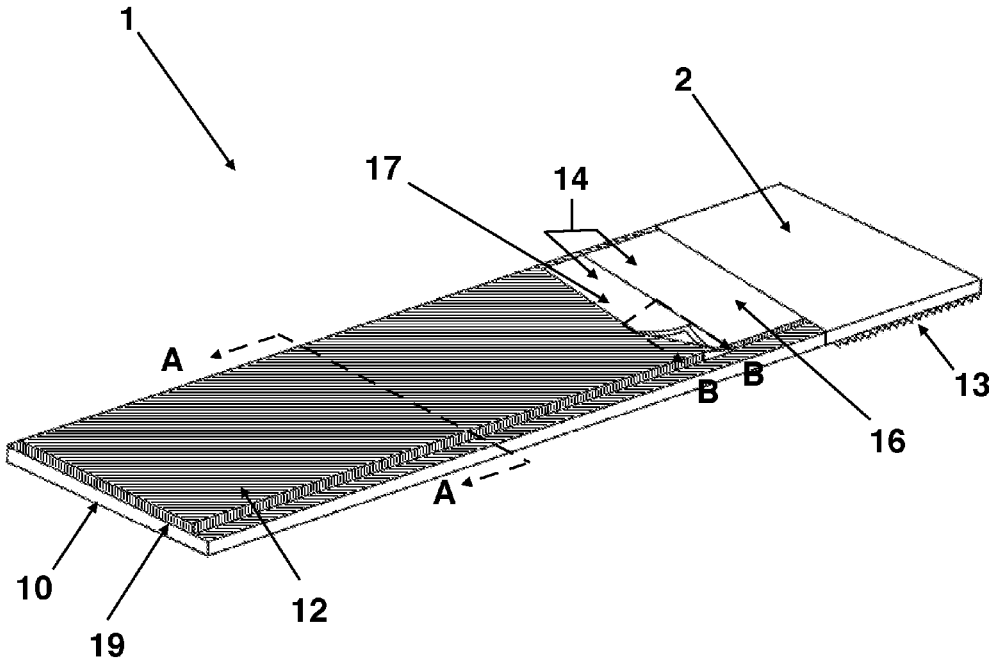
FIG. 1 depicts the topside of the strap, showing the pocket and open enclosure, the active surface of the Velcro loop side, and the non-active hook side of the Velcro closure element.

FIG. 1 depicts the topside of a multipurpose strap device 1. Shown is the non active surface of the Velcro second gender strap closure element 2 and the active surface of the Velcro second gender strap closure element 13, which are sewn to the Velcro first gender substrate 12, which depicts Velcro attached to a substrate. Also shown is a pocket 16 and an open enclosure 17, which are two compartments formed by and from the pocket and open enclosure forming piece of leather 14. Additionally, FIG. 1 includes the sewing 19 that attaches the soft leather substrate 10, which is more clearly illustrated in FIG. 2, and the Velcro first gender substrate 12.

Figure 2:
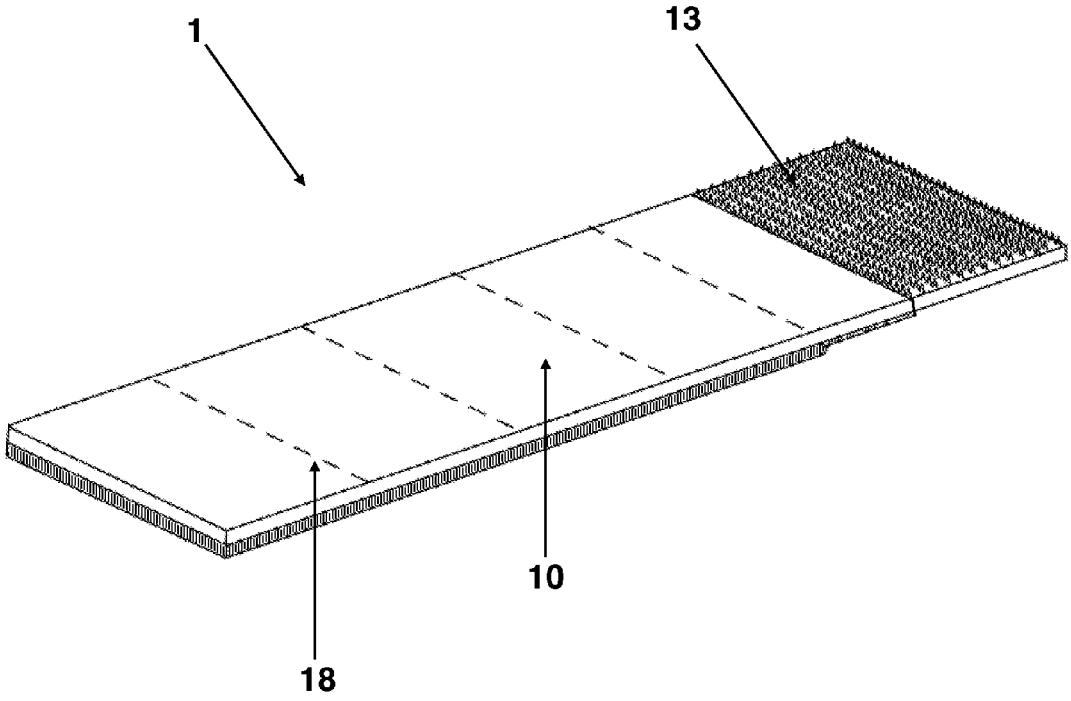
FIG. 2 depicts the bottom side of the strap, showing the soft leather and the active surface of the Velcro closure element hook side.

FIG. 2 depicts the bottom side of the multipurpose strap device 1, showing the soft leather substrate 10 and the active surface of the Velcro second gender strap closure element 13. Also shown are the fold zones 18, which enable the multipurpose strap device 1 to fold up into various shapes, including that of a wallet.

Figure 3:
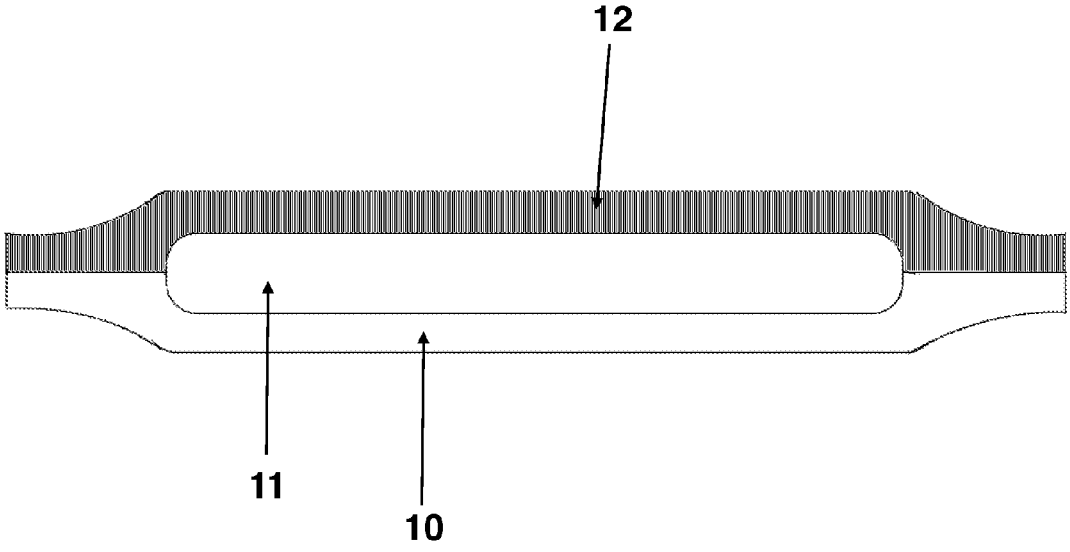
FIG. 3 depicts a cross-section view in the middle region of the Multipurpose Strap Device.

FIG. 3 depicts a cross-section view of the middle region of the multipurpose strap device whereby said cross-section view is along AA as shown in FIG. 1. In this FIG. 3, the structural piece or bull nose 11 is sandwiched between the Velcro first gender substrate 12 and the soft leather substrate 10. Not shown are the stitches that hold the Velcro first gender substrate 12 and the soft leather substrate 10 together to the left and right of the structural piece or bull nose 11.

Figure 4:
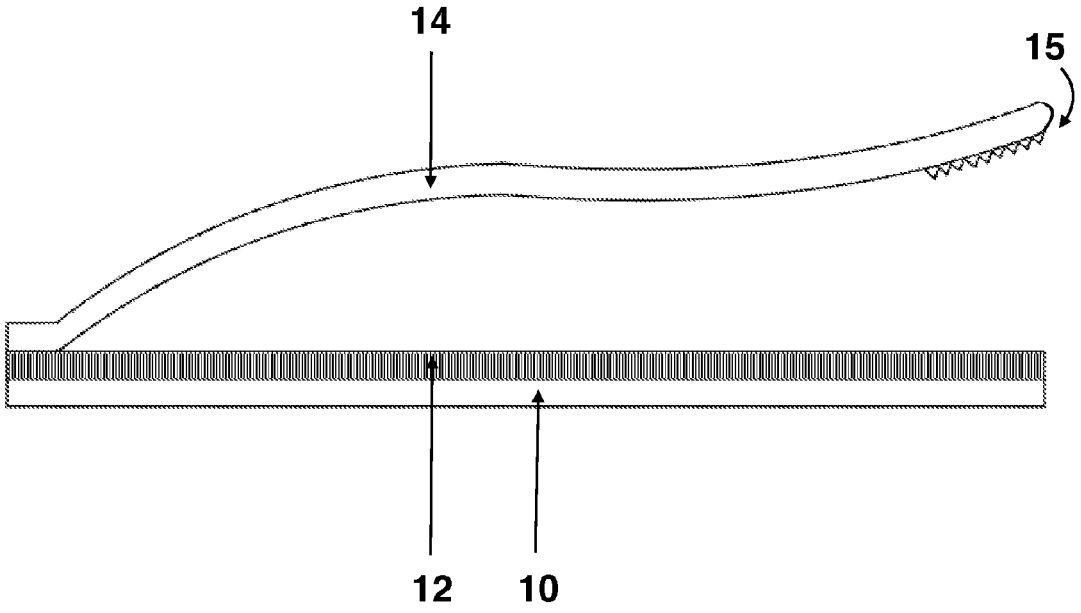
FIG. 4 depicts a cross-section view of the pocket region.

FIG. 4 depicts a cross-section view of the pocket region of one embodiment of the multipurpose strap device whereby said cross-section view is along BB as shown in FIG. 1. The Velcro second gender pocket closure element 15 is sewn to the pocket and open enclosure forming piece of leather 14. The pocket and open enclosure forming piece of leather 14 is sewn to the Velcro first gender substrate 12, which in turn is sewn to the soft leather substrate 10.

COMPONENT LIST FOR DRAWINGS

Following is a partial list of the components depicted in the drawings:

| Component Number | Component Description |
|---|---|
| 1 | Multipurpose Strap Device |
| 2 | Non Active Surface of Velcro Second Gender Strap Closure Element |
| 10 | Soft Leather Substrate |
| 11 | Structural Piece or Bull Nose |
| 12 | Velcro First Gender Substrate |
| 13 | Active Surface of Velcro Second Gender Strap Closure Element |
| 14 | Pocket and Open Enclosure forming Piece of Leather |
| 15 | Velcro Second Gender Pocket Closure Element |
| 16 | Pocket |
| 17 | Open Enclosure |
| 18 | Fold Zone |

DEFINITIONS

As used herein, the term "and/or," when used in a list of two or more items, means that any one of the listed items can be employed by itself, or any combination of two or more of the listed items can be employed. For example, if a device is described as containing components A, B, and/or C, the composition can contain A alone; B alone; C alone; A and B in combination; A and C in combination; B and C in combination; or A, B, and C in combination.

As used herein, the term "multipurpose strap device" means the present invention, namely the MULTIPURPOSE STRAP DEVICE FOR SECURING, FASTENING, REMOVABLY ATTACHING, CARRYING, STORING, HOLDING, AND/OR LOCKING ITEMS AND/OR OBJECTS.

As used herein, the term "bull nose" means a structural piece contained within and/or attached to a belt or strap that enables the belt or strap to be more easily handled when threaded through loops and/or holes and/or spaces contained within objects.

As used herein, the term "helmet face shield hole" means the portion of a motorcycle helmet that the user or wearer sees through. On helmets with a face shield (which is made of a clear and/or tinted plastic), when the face shield is raised, this exposes the portion of the motorcycle helmet that the user or wearer sees through.

As used herein, the term "helmet opening" means the portion of a helmet that fits over the head and comes to rest around the user's neck when the helmet is worn by a user.

As used herein, the term "motorcycle seat strap" means a motorcycle seat firs on a motorcycle, and is oriented with a front to back axis that is oriented in the direction of motion of the motorcycle. The motorcycle seat strap is a strap on the motorcycle seat and is oriented perpendicularly to the axis of motorcycle motion on said seat.

As used herein, the term "Velcro" and "Velcro gender" means either or both genders of Velcro, where Velcro consists in total of a first material possessing a first gender of Velcro and a second material possessing a second gender Velcro. The first material possessing a first gender of Velcro possesses an active surface and a non-active surface. The second material possessing a second gender of Velcro possesses an active surface and a non-active surface. The active surface of the first material possessing a first gender of Velcro attaches to the active surface of the second material possessing a second gender of Velcro.

As used herein, the term "leather pocket subassembly" means a subassembly formed by the union of the Velcro second gender pocket closure element and the pocket and open enclosure forming piece of leather.

As used herein, the term "Velcro attachment stitches" means a line of stitches that connect the Velcro second gender strap closure element to the Velcro first gender substrate.

As used herein, the term "Velcro and pocket subassembly" means a subassembly formed by the attachment of the leather pocket subassembly to the velcro subassembly.

As used herein, the term "Velcro subassembly" means subassembly formed by the union of the Velcro second gender strap closure element and the Velcro first gender substrate.

What is claimed:

1. A multipurpose strap device for securing, fastening, removably attaching, carrying, storing, holding, and locking items (the "multipurpose strap device") comprising:

a first end;

a second end;

at least one first flat smooth substrate;

at least one second flat smooth substrate;

at least one third flat smooth substrate;

at least one structural piece or bull nose;

at least one permanent attachment between at least two of: said at least one first substrate, said at least one second substrate, said at least one third substrate which secures, and connects them permanently on at least three sides;

at least one removable attachment between said at least one second substrate and said at least one third substrate;

at least one of: the said at least one first substrate, at least one second substrate, at least third substrate, having at least one indent or cross-section changing section, whereby the said at least one indent or cross-section changing section provides at least one zone of flexure;

wherein said at least one zone of flexure allows for folding or rolling along said at least one zone of flexure allowing for the strap to fold into itself;

at least one pocket;

wherein said at least one pocket is attached to at least one of: the said at least one first substrate and said at least one second substrate;

wherein said at least one structural piece or bull nose is permanently contained within said at least one first substrate and said at least one second substrate; and wherein the at least one first substrate lies flat on top of the at least one said second substrate with no slack.

2. The multipurpose strap device of claim 1 wherein the said at least one first substrate, said at least one second substrate, and said at least one third substrate are composed of at least one of: natural or synthetic material, leather, animal hide, cotton, wool, fabric, nylon, rayon, plastic, metal, ceramic, composite material, recycled material, hook and loop fasteners, or any combination thereof.

3. The multipurpose strap device of claim 1 wherein said permanent attachment means is sewing.

4. The multipurpose strap device of claim 1 wherein at least one of the said at least one first substrate, said at least one second substrate, said at least one third substrate has attached at least one first gender of a hook and loop fastener, and at least one of the said at least one first substrate, said at least one second substrate, said at least one third substrate, has attached at least one second gender of the hook and loop fastener.

5. The multipurpose strap device of claim 1 wherein said removable attachment is at least one removable method of attachment comprising a hook and loop fastener.

6. The multipurpose strap device of claim 1 wherein said at least one structural piece or bull nose is composed from at least one of natural or synthetic material, leather, animal hide, cotton, wool, fabric, nylon, rayon, plastic, metal, ceramic, wood, or any combination thereof.

7. The multipurpose strap device of claim 1 wherein said at least one structural piece or bull nose is contained within and between a space formed between the at least one first substrate and the at least one second substrate.

* * * * *